US009022375B2

(12) United States Patent
Allred, III et al.

(10) Patent No.: US 9,022,375 B2
(45) Date of Patent: May 5, 2015

(54) ADJUSTABLE C-CLAMP SYSTEM

(71) Applicant: Allred & Associates Inc., Elbridge, NY (US)

(72) Inventors: Jimmie B. Allred, III, Skaneateles, NY (US); Edmund Zielinski, Liverpool, NY (US); Joseph Kummer, Fayetteville, NY (US)

(73) Assignee: Allred & Associates Inc., Elbridge, NY (US)

( * ) Notice: Subject to any disclaimer, the term of this patent is extended or adjusted under 35 U.S.C. 154(b) by 348 days.

(21) Appl. No.: 13/706,783

(22) Filed: Dec. 6, 2012

(65) Prior Publication Data

US 2013/0140750 A1 Jun. 6, 2013

Related U.S. Application Data

(60) Provisional application No. 61/567,345, filed on Dec. 6, 2011.

(51) Int. Cl.

| | |
|---|---|
| ***B25B 5/00*** | (2006.01) |
| ***B25B 5/06*** | (2006.01) |
| ***B25B 5/10*** | (2006.01) |

(52) U.S. Cl.

CPC ..... *B25B 5/067* (2013.01); *B25B 5/003* (2013.01); *B25B 5/101* (2013.01); *B25B 5/102* (2013.01)

(58) Field of Classification Search

USPC ..... 269/143, 148, 249, 3, 6, 95; 29/276, 29/257

See application file for complete search history.

(56) References Cited

U.S. PATENT DOCUMENTS

| | | | | |
|---|---|---|---|---|
| 252,581 | A * | 1/1882 | Butler | 74/1.5 |
| 1,039,831 | A * | 10/1912 | Sisson | 269/3 |
| 4,926,722 | A | 5/1990 | Sorensen et al. | |
| 4,962,918 | A | 10/1990 | Yang | |
| 5,933,935 | A * | 8/1999 | Alcorn | 29/229 |
| 6,290,219 | B1 | 9/2001 | Barbosa | |
| 6,598,868 | B2 * | 7/2003 | Gortner | 269/219 |
| 7,389,978 | B2 | 6/2008 | Rowlay et al. | |
| 8,001,872 | B2 * | 8/2011 | Gorrie | 81/3.4 |
| 2006/0108729 | A1 * | 5/2006 | Siegel | 269/266 |

OTHER PUBLICATIONS

Dagger Tools C-clamp pliers, http://www.daggertools.com/m5/PGA20S--long-reach-locking-c-clamp-pliers.html, at least as early as 2012.

Irwin C-clamp pliers, http://www.buy.com/prod/irwin-original-long-reach-locking-c-clamp-pliers-18-tool-length-8- jaw/203154463.html, at least as early as 2012.

* cited by examiner

*Primary Examiner* — Lee D Wilson
*Assistant Examiner* — Nirvana Deonauth
(74) *Attorney, Agent, or Firm* — Brown & Michaels, PC

(57) ABSTRACT

A c-shaped clamp tool system preferably includes slider arms, one or more slider arm supports, pads, one or more threaded rods, and turning knobs. The clamping system preferably includes multiple slider arms and slider arm supports of different lengths. In a preferred embodiment, the slider arms are made of unidirectional pultruded carbon fiber and the slider arm support is made of woven carbon fiber.

20 Claims, 12 Drawing Sheets

ADJUSTABLE C-CLAMP SYSTEM

REFERENCE TO RELATED APPLICATIONS

This application claims one or more inventions which were disclosed in Provisional Application No. 61/567,345, filed Dec. 6, 2011, entitled "ADJUSTABLE C-CLAMP SYSTEM". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of clamps. More particularly, the invention pertains to c-clamps used in securing objects.

2. Description of Related Art

Many patents have been issued related to c-clamp tools; however, none offers the ability to rapidly change the arm length and clamp depth independently using a split main body.

The width of the clamp is easily adjustable using designs like bar clamps. Numerous patents exist for bar clamps, for example, U.S. Pat. No. 4,926,722 (Sorensen), which discloses a bar clamp for one hand and includes a fixed jaw and a movable jaw, and U.S. Pat. No. 7,389,978 (Rowlay), which discloses a jaw for a bar clamp including a trigger with two force applying mechanisms that are applied at different times.

U.S. Pat. No. 6,290,219 (Barbosa) discloses a c-clamp plier with an extension arm used to support the plier. Here, the plier slides and can be held fixed at any point along the support extension arm.

U.S. Pat. No. 4,962,918 (Yang) discloses an extendable c-clamp where the arms can be lengthened through the use of telescoping brackets.

SUMMARY OF THE INVENTION

In an improved c-shaped clamp tool, both the arm length and the clamp depth are adjustable. In a preferred embodiment, the slider arm support is made of woven carbon fiber and the arms are made of unidirectional carbon fiber. Slots in the slider arm support allow the distance between the arms to be adjusted, as well as the position of the slider arm support relative to an end of each arm.

DETAILED DESCRIPTION OF THE INVENTION

Standard c-shaped clamps have been used for many years. Some uses for c-clamps include, but are not limited to, wood working, and in particular in the construction of musical instruments. Current c-clamps are made from metal, for example steel or aluminum, or from plastic. In the construction of musical instruments, as well as other delicate wood assemblies, a need exists for lightweight, easily adjustable c-clamps. The new type of clamping system disclosed herein offers an improvement over current clamps by allowing the user to decide both the arm length and clamp depth.

Figure 1:
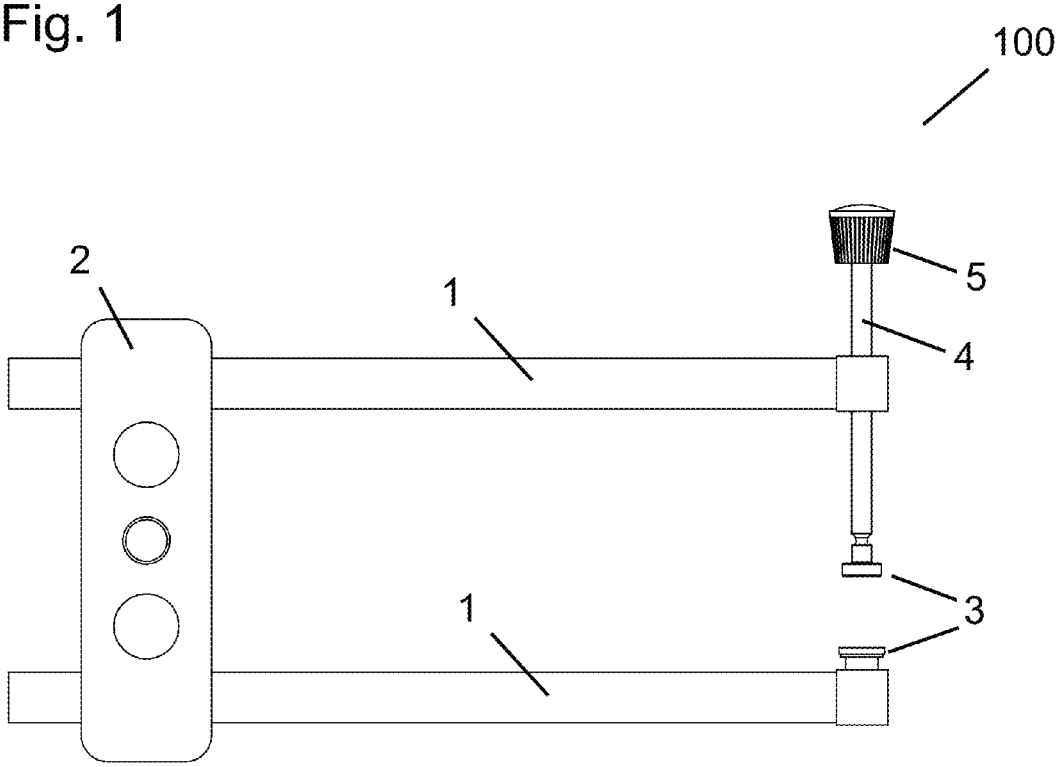
FIG. 1 shows a side view of a c-clamp in an embodiment of the present invention.
Figure 2:
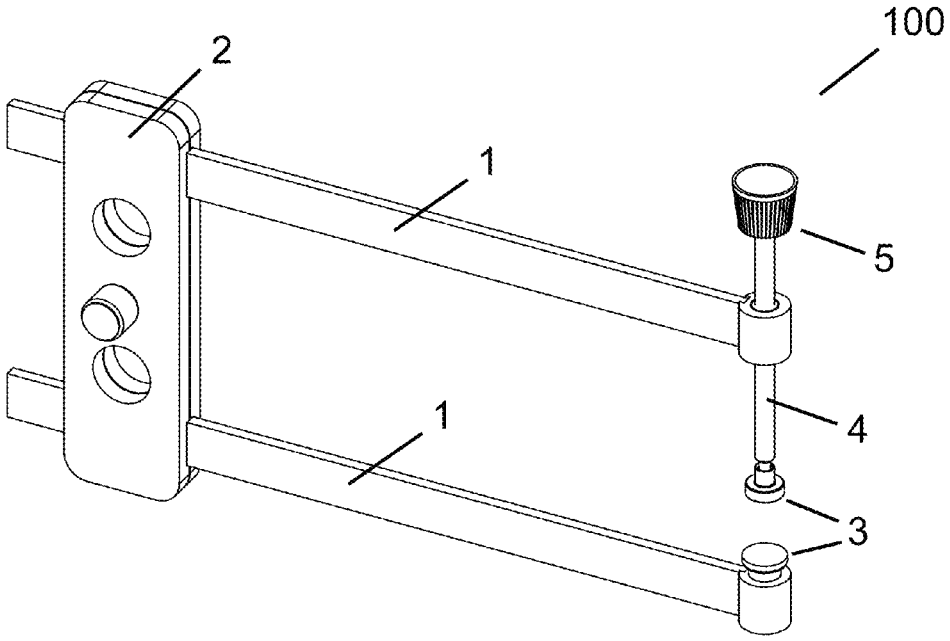
FIG. 2 shows an angled view of the c-clamp of FIG. 1.

FIG. 1 shows a side view and FIG. 2 an angled view of an assembled c-clamp 100 in an embodiment of the present invention. The c-clamp 100 includes slider arms 1, a slider arm support 2, pads 3, a threaded rod 4, and a knob 5. Although a knob 5 is shown in the figures, alternative turning mechanisms, such as screws, could be used instead of the knob 5. In other embodiments, the clamps described herein would also work without a turning mechanism. In embodiments without a turning mechanism, the threaded rod 4 itself would be turned to tighten or loosen the clamp 100.

In use, the knob 5 is turned to adjust the distance between the pads 3. When the clamp 100 is tightened, the knob 5 is turned until the object is secured in place. To loosen the clamp 100, the knob 5 is turned in the opposite direction until the secured object can be moved or removed.

Figure 3:
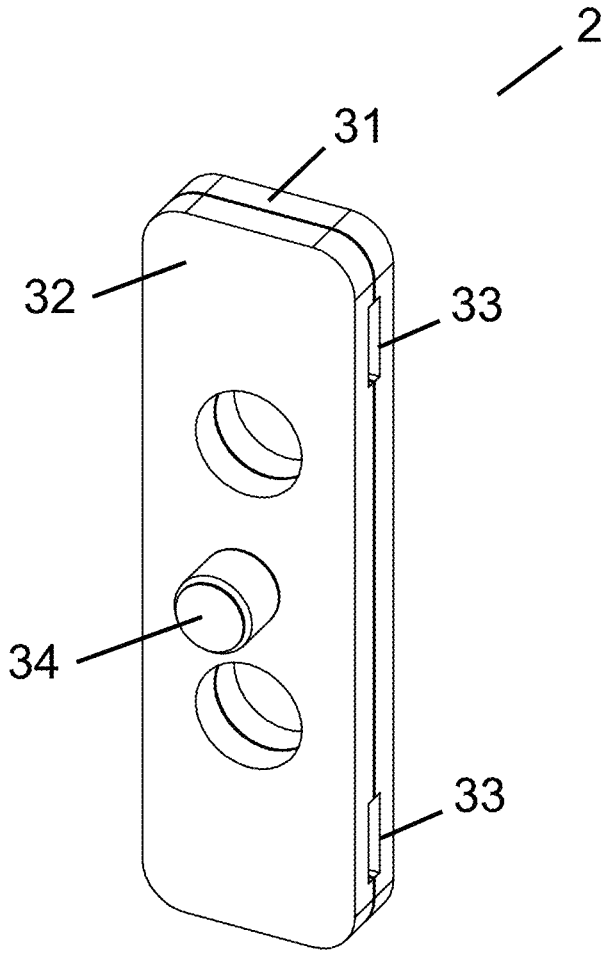
FIG. 3 shows a close-up view of the slider arm support.
Figure 4:
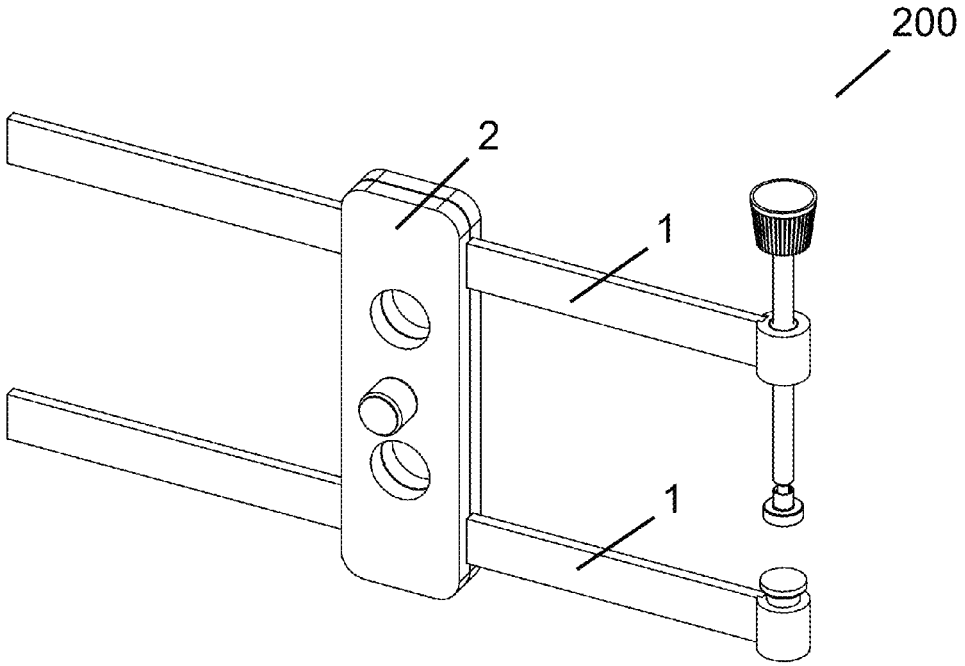
FIG. 4 shows the clamp of FIG. 1 adjusted to a shallower depth.
Figure 5:
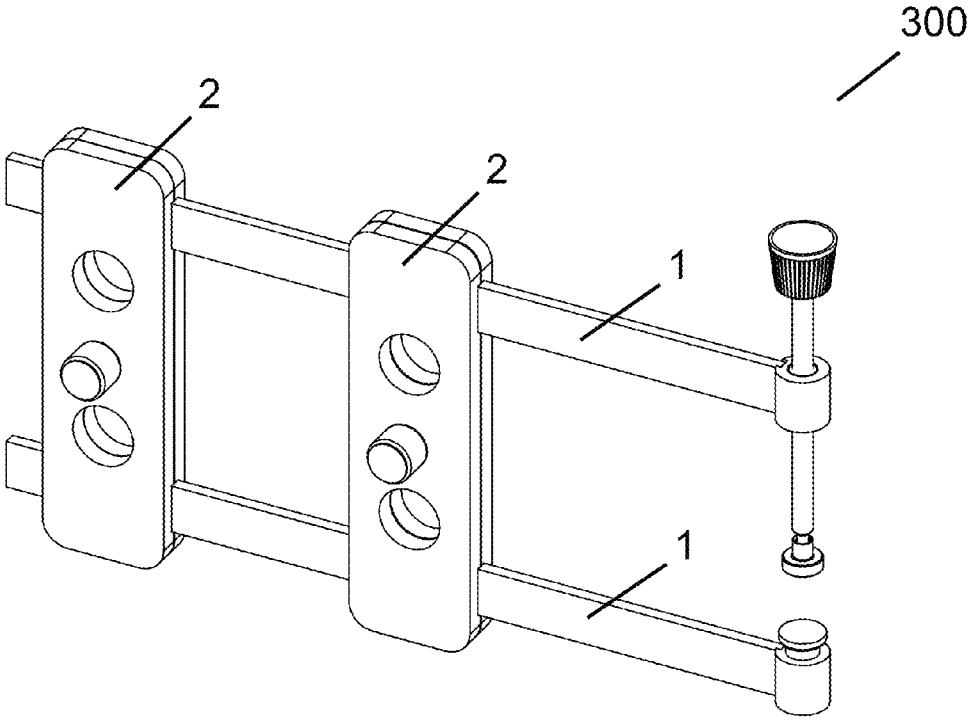
FIG. 5 shows the clamp of FIG. 4 with a second slider arm support.

FIG. 3 shows a slider arm support 2. The support 2 is preferably made from two clamshell parts 31 and 32, but could alternatively be made from a single part. In the support 2 embodiment shown in FIG. 3, the clamshell pieces 31 and 32 are screwed together by a turning knob 34. In preferred embodiments, the turning knob 34 includes threads and the holes in the clamshell pieces 31 and 32 that receive the turning knob 34 include corresponding threads. Slots 33 provide the receptacles for the slider arms 1 to slide into and along. FIG. 4 shows the slider arm support 2 moved to the middle position of the slider arms 1, creating a c-clamp 200 with a shortened depth. To further improve clamp stiffness, a second slider arm support 2 can be added at the end of the slider arms 1 to create a double slider arm c-clamp 300, as shown FIG. 5.

Figure 6:
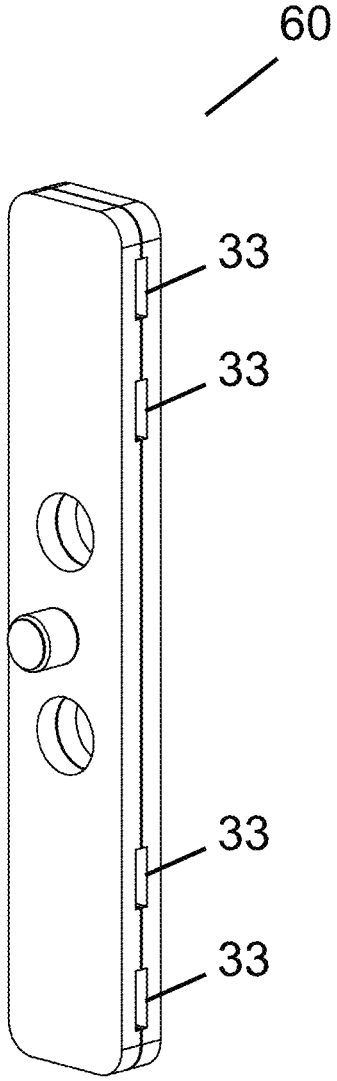
FIG. 6 shows an alternate slider arm support with multiple slider arm receptacles.
Figure 7:
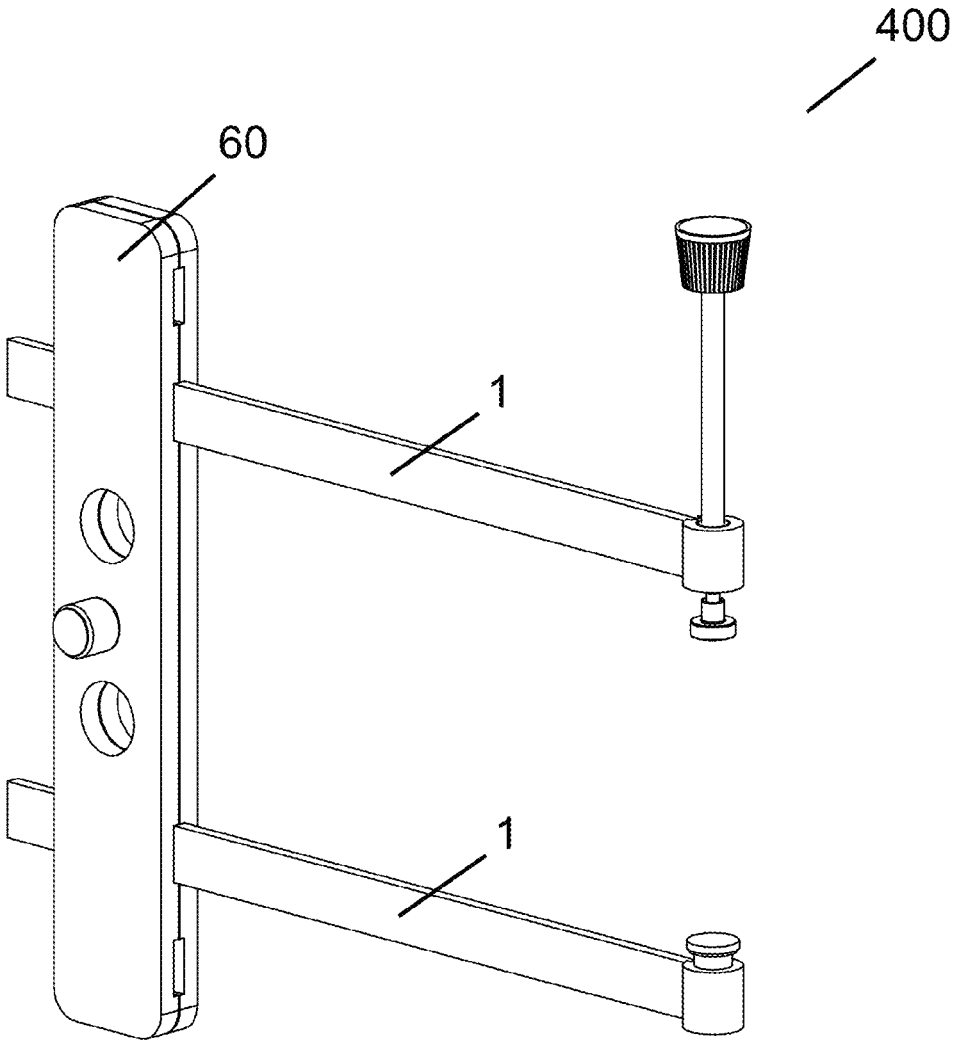
FIG. 7 shows a c-clamp in an embodiment of the present invention with the slider arms adjusted to be narrow.
Figure 8:
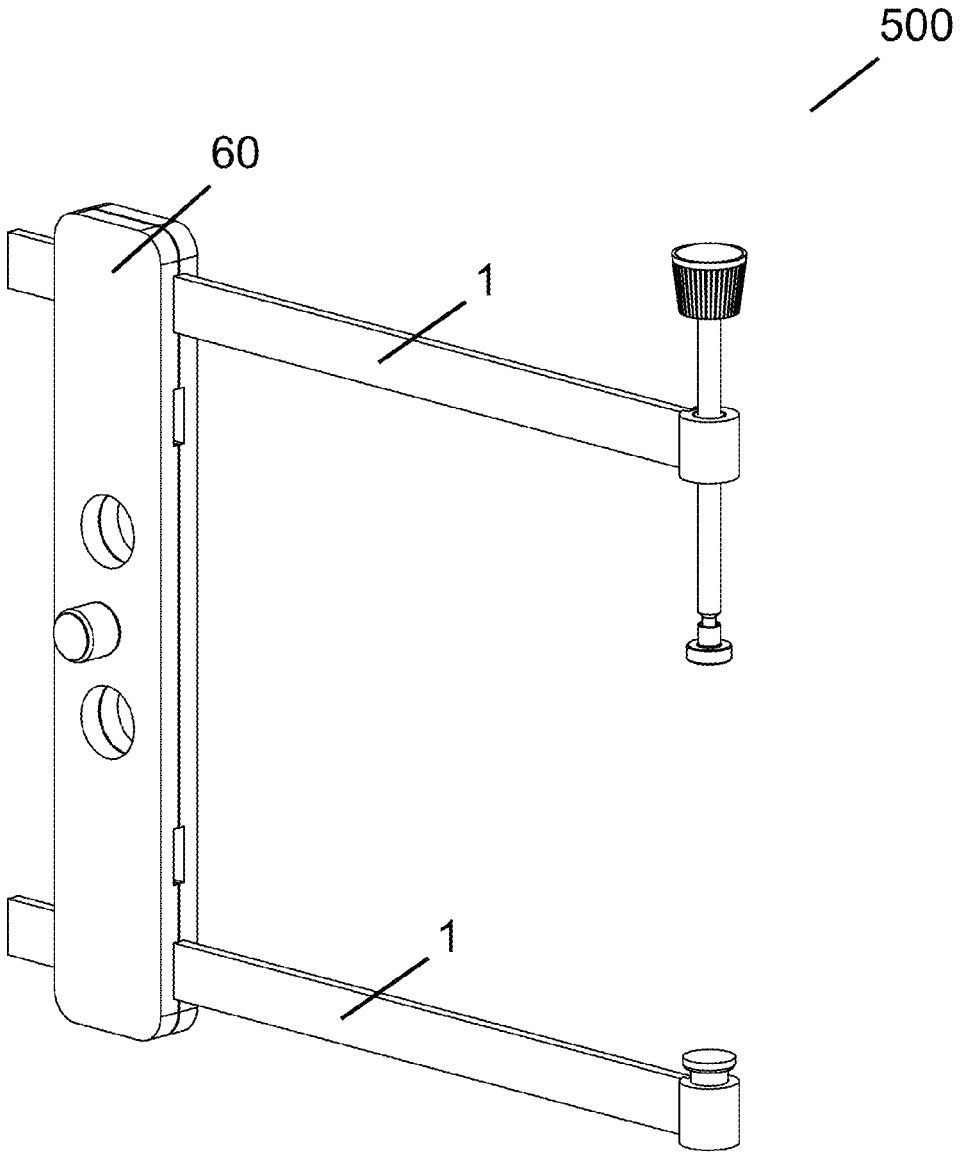
FIG. 8 shows a c-clamp in an embodiment of the present invention with the slider arms adjusted to be wide.

FIG. 6 shows an alternate embodiment of a slider arm support 60 with multiple slider arm slots 33. The slider arm support 60 allows the creation of both a narrow c-clamp 400, as shown in FIG. 7, and a wide c-clamp 500, as shown in FIG. 8, using the same components. FIG. 7 shows the slider arms 1 utilizing the narrow slider arm slots, while FIG. 8 shows the slider arms 1 utilizing the wide slider arm slots. In other embodiments, the slider arms 1 could utilize one of the narrower slider arm slots and one of the wider slider arm slots. With relatively few components, many different variations in both clamp width and depth are possible, making this c-clamp compact and robust.

Figure 9:
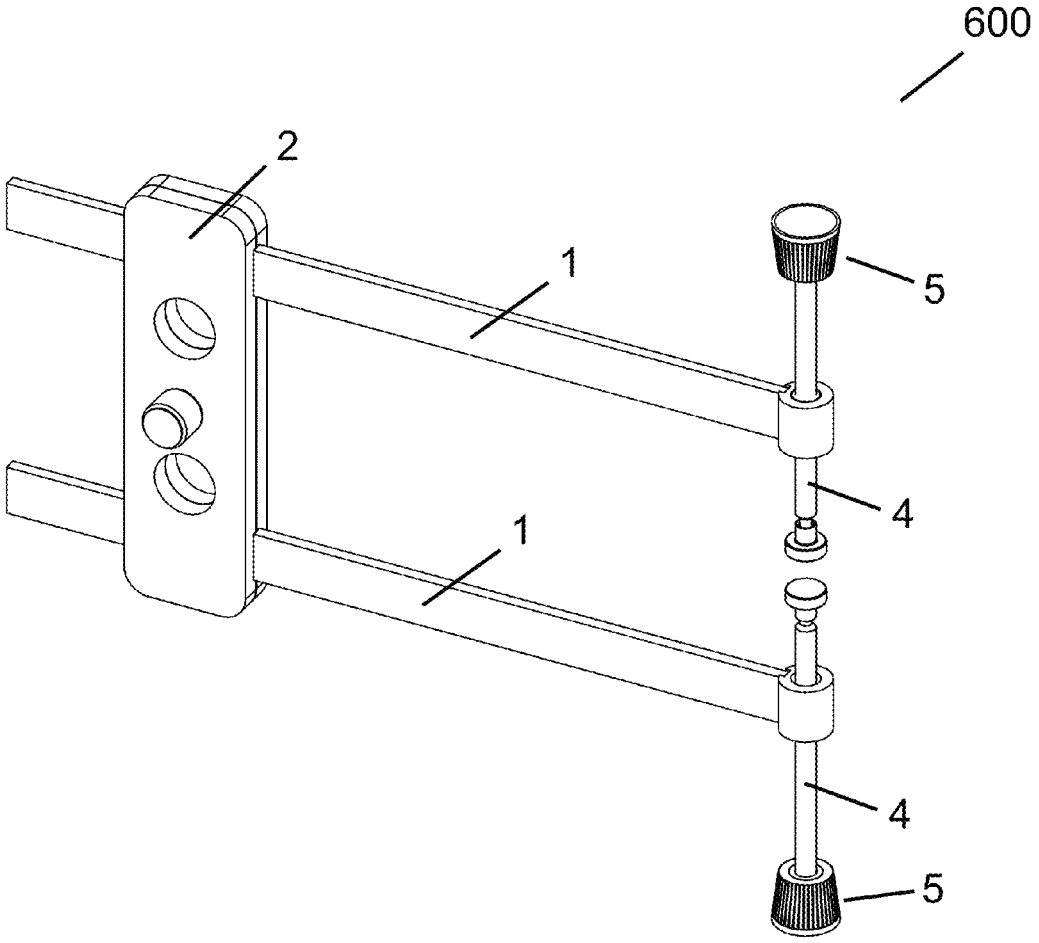
FIG. 9 shows the clamp of FIG. 1 with two threaded rods.

FIG. 9 shows an alternate embodiment of a c-clamp 600 with a second threaded rod 4 and knob 5 replacing the lower pad 3 from the c-clamp 100 in FIG. 1. This embodiment gives additional flexibility to the positioning of the clamped part relative to the slider arms 1.

Figure 10:
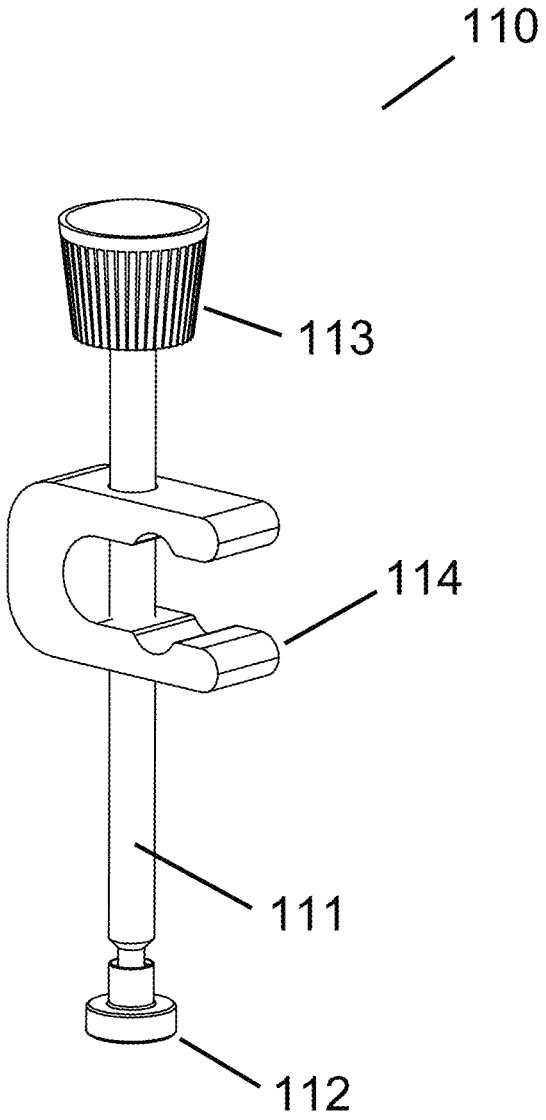
FIG. 10 shows a vertical clamp support of the present invention.
Figure 11:
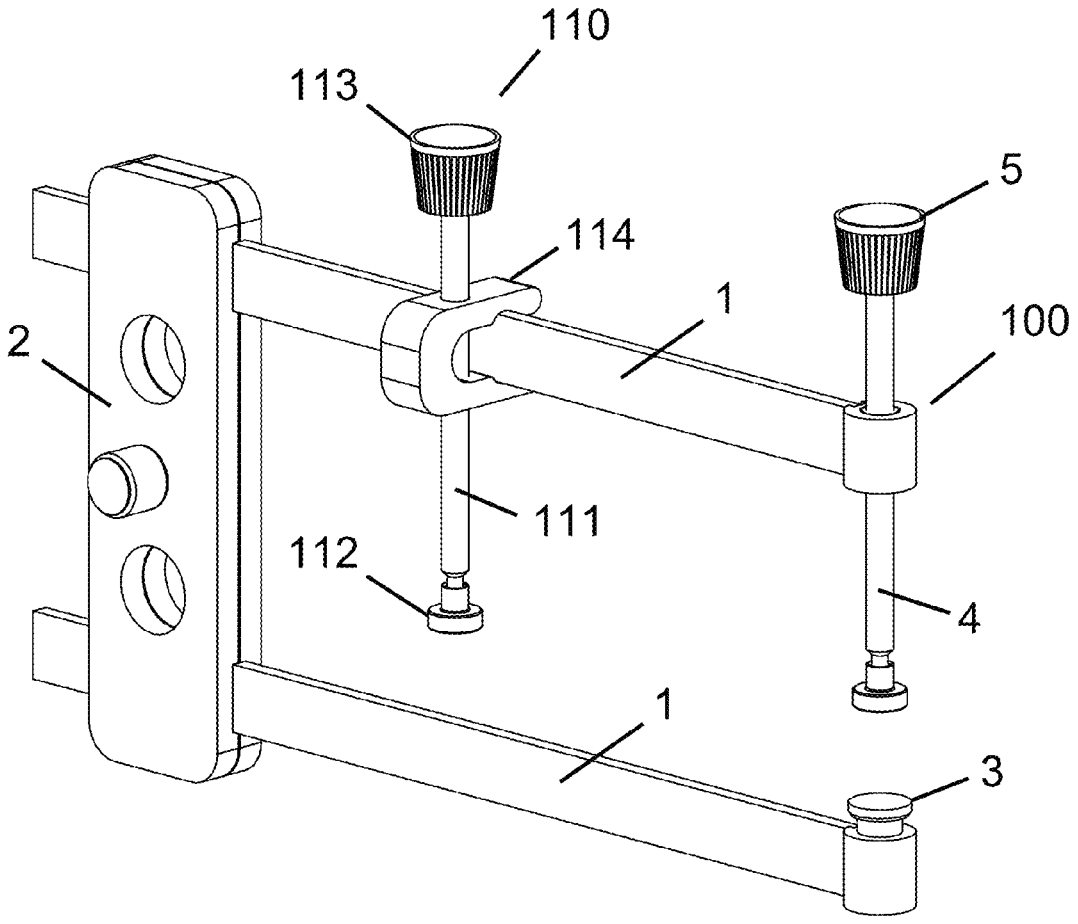
FIG. 11 shows the vertical clamp support of FIG. 10 attached to the c-clamp of FIG. 1.

FIG. 10 shows a vertical clamp support 110 in an embodiment of the present invention. The vertical clamp support 110 includes a threaded rod 111, a pad 112, a knob 113, and a connector bracket 114. FIG. 11 shows the vertical clamp support 110 attached to a c-clamp 100. The vertical clamp support 110 is able to slide along the slider arms 1, and, by turning the knob 113, tightens the pad 112 up or down, providing support for the c-clamp 100 by prohibiting the clamp from sagging vertically under its own weight.

The components of the c-clamp can be made from any stiff material that can adequately withstand the applied stresses, such as aluminum, steel, or another metal. For light duty applications, plastic components can be used. In a preferred embodiment, the c-clamps described herein include unidirectional pultruded carbon fiber or fiberglass for the slider arms 1 and/or woven carbon fiber or fiberglass for the slider arm support 2, 60.

In some embodiments where carbon fiber is used, torsional rigidity can be increased by embedding metal or another highly stiff material within the middle of the carbon fiber layers. For example, steel, aluminum, titanium, or another metal add significant torsional rigidity to the clamp when placed in the middle of the slider arms 1 or the slider arm supports 2, 60, with the carbon fibers surrounding the metal. This construction also improves the impact resistance of the clamp.

In order to create a carbon fiber c-clamp that does not readily conduct electricity, one or more layers of a material including, but not limited to, fiberglass, aramid fiber mesh, another non-conducting material, or a combination of these materials can be added to the outside or outermost layers of the clamp.

A c-clamp kit or system may be created by combining several different length slider arms 1, with one or more slider arm supports 2 or 60, and correspondingly long threaded rods 4.

Figure 12:
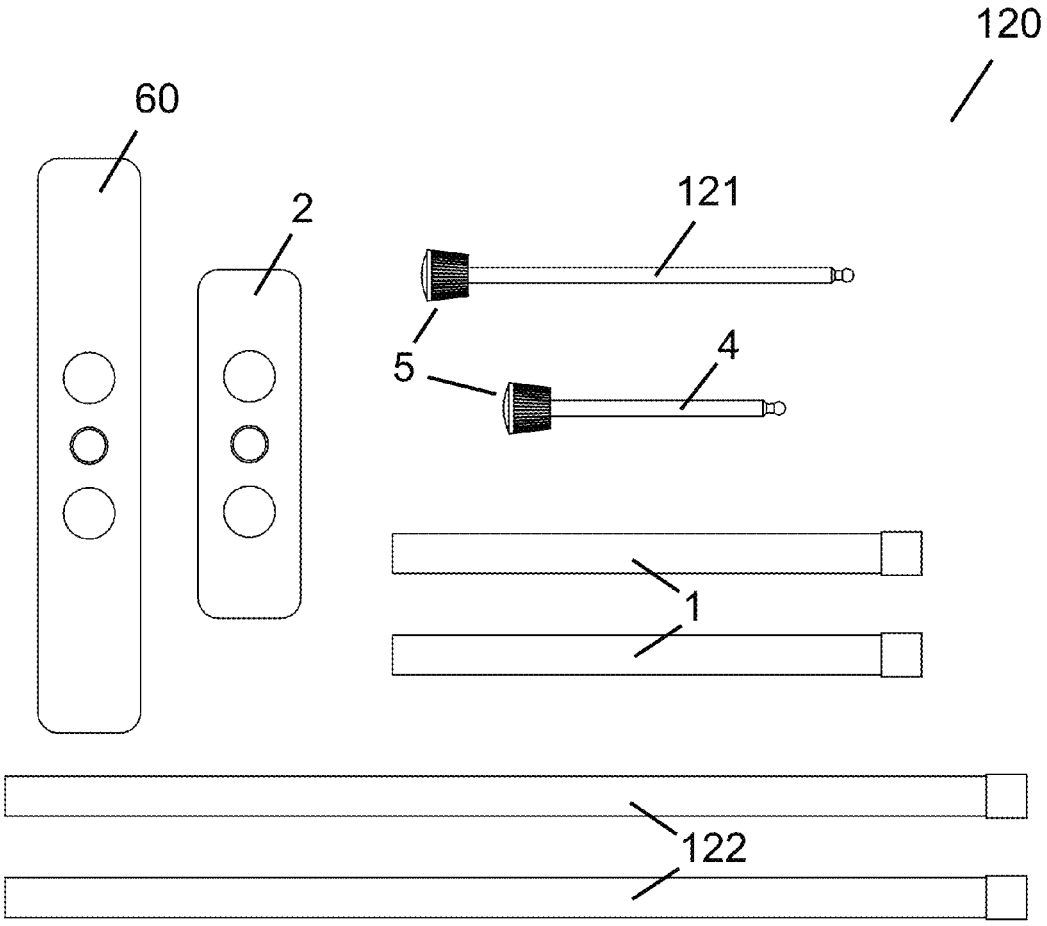
FIG. 12 shows a c-clamp system comprising two sliding arm supports, four sliding arms, and two threaded rods.

As an example, FIG. 12 shows a c-clamp kit or system 120 created by combining two slider arm supports 2, 60 of different sizes, two pairs of slider arms 1, 122 of different lengths, and two threaded rods 4, 121 of different lengths. While two sizes of each of the slider arm supports 2, 60, the slider arms 1, 122, and the threaded rods 4, 121 are shown in FIG. 12, additional sizes of each or all of these components could be optionally included in the system. Alternatively, one or more of the components, for example the threaded rods 4, 121, could be provided in only one length. In addition, while one of the slider arm supports 2 shown in this figure includes two slots and the other slider arm support 60 includes four slots, each of the slider arm supports in the system may include two or more slots. This system provides a user with a wide range of c-clamp sizes, both in length and depth, with a very small number of components, since the components can be combined in many different ways.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A c-clamp comprising:

a) a first slider arm support comprising at least two slots that extend through an entire width of the first slider arm support;

b) a first slider arm disposed through a first slot in the first slider arm support;

c) a second slider arm disposed through a second slot in the first slider arm support; and d) at least a first threaded rod disposed perpendicular through a first sleeve in the first slider arm and adjustably attached to an end of the first slider arm such that the threaded rod is moved to tighten and loosen the clamp;

wherein the slider arm support is configured to slide along the slider arms.

2. The c-clamp of claim 1, wherein the first slider arm support comprises two halves.

3. The c-clamp of claim 2, wherein the slider arm support halves are tightened together.

4. The c-clamp of claim 3, wherein the first and second slider arms are held fixed by the tightened slider arm support halves.

5. The c-clamp of claim 1, wherein the c-clamp further comprises:

a) a second sleeve at an end of the second arm, wherein the first threaded rod extends towards the second sleeve through an opening in the first sleeve;

b) a first pad at an end of the first threaded rod facing the second sleeve; and c) a second pad located on a side of the second sleeve facing the first threaded rod.

6. The c-clamp of claim 5, further comprising a turning mechanism at an end of the first threaded rod opposite the first pad.

7. The c-clamp of claim 5, further comprising a second threaded rod extending towards the first sleeve through an opening in the second sleeve.

8. The c-clamp of claim 5, further comprising a threaded insert in at least one of the first sleeve or the second sleeve.

9. The c-clamp of claim 1, wherein at least one of the first slider arm support, first slider arm, or second slider arm comprise carbon fiber.

10. The c-clamp of claim 1, wherein the first slider arm support comprises woven carbon fiber.

11. The c-clamp of claim 10, wherein the first slider arm support further comprises a material core that is not made of carbon fiber.

12. The c-clamp of claim 11, wherein the material core is selected from the group consisting of steel; aluminum; and titanium.

13. The c-clamp of claim 1, wherein the first slider arm, the second slider arm, or both the first slider arm and the second slider arm comprise a material selected from the group consisting of uni-directional carbon fiber and pultruded carbon fiber.

14. The c-clamp of claim 13, wherein the first slider arm, the second slider arm, or both the first slider arm and the second slider arm comprise a material core that is not made of carbon fiber.

15. The c-clamp of claim 14, wherein the material core is selected from the group consisting of steel; aluminum; and titanium.

16. The c-clamp of claim 1, further comprising a second slider arm support, wherein the slots in the second slider arm support are in line with the slots in the first slider arm support.

17. The c-clamp of claim 1, wherein the first slider arm support has greater than two slots.

18. The c-clamp of claim 1, further comprising at least one vertical clamp support attached to either the first or second slider arms.

19. A c-clamp system comprising:

a) a first slider arm support having a first slider arm support length and comprising at least two slots that extend through an entire width of the first slider arm support;

b) a second slider arm support having a second slider arm length different from the first slider arm support length and comprising at least two slots that extend through an entire width of the second slider arm support;

c) a first slider arm having a first slider arm length;

d) a second slider arm having the first slider arm length;

e) a third slider arm having a second slider arm length different than the first slider arm length; and f) a fourth slider arm with the second slider arm length;

wherein either the first and second slider arms or the third and fourth slider arms are retained by the slots in either the first slider arm support or the second slider arm support; wherein the slider arm supports are configured to slide along the slider arms.

20. The c-clamp system of claim 19, further comprising:

g) a first threaded rod having a first threaded rod length; and h) a second threaded rod having a second threaded rod length different from the first threaded rod length;

wherein either the first threaded rod or the second threaded rod is adjustably attached to an end of the first slider arm or the third slider arm such that the first threaded rod or the second threaded rod is moved to tighten and loosen the c-clamp.

* * * * *